US007927054B2

(12) United States Patent
Brommer et al.

(10) Patent No.: US 7,927,054 B2
(45) **Date of Patent: *Apr. 19, 2011**

(54) BINDING-IN MACHINE

(75) Inventors: Carsten Brommer, Tecklenburg/Leeden (DE); Manfred Albrecht, Luebbecke (DE)

(73) Assignee: Kolbus GmbH & Co. KG, Rahden (DE)

( * ) Notice: Subject to any disclaimer, the term of this patent is extended or adjusted under 35 U.S.C. 154(b) by 739 days.

This patent is subject to a terminal disclaimer.

(21) Appl. No.: 11/999,121

(22) Filed: Dec. 4, 2007

(65) Prior Publication Data

US 2008/0138172 A1 Jun. 12, 2008

(30) Foreign Application Priority Data

Dec. 9, 2006 (DE) ..... 10 2006 058 091

(51) Int. Cl.
*B42C 11/02* (2006.01)

(52) U.S. Cl. ..... 412/19

(58) Field of Classification Search ..... 412/22, 412/5, 19

See application file for complete search history.

(56) References Cited

U.S. PATENT DOCUMENTS

| | | | | |
|---|---|---|---|---|
| 2,921,322 | A | 1/1960 | Crawley et al. | |
| 5,141,377 | A * | 8/1992 | Rathert | 412/22 |
| 2006/0140742 | A1 * | 6/2006 | Brommer et al. | 412/22 |

FOREIGN PATENT DOCUMENTS

| | | | |
|---|---|---|---|
| DE | 44 22 783 | A1 | 1/1996 |
| DE | 10 2004 061 995 | A1 | 7/2006 |
| EP | 0 384 129 | B1 | 6/1993 |

* cited by examiner

*Primary Examiner* — Dana Ross
*Assistant Examiner* — Matthew G Katcoff
(74) *Attorney, Agent, or Firm* — Alix, Yale & Ristas, LLP

(57) ABSTRACT

In order to realize a particularly compact binding-in machine (40), the pressing devices (41) with the firmly assigned joint forming devices (42) can be driven along a circulation path that essentially lies in a vertical plane, wherein the pressing plates (41.1) of the pressing devices (41) are oriented parallel to this plane. The pressing devices (41) and the joint forming devices (42) are simply arranged on a rotor (40.3) that rotates about a horizontal axis (40.4), wherein the axis of rotation (40.4) of the rotor is oriented perpendicular to the pressing plates (41.0). This significantly simplifies the infeed and the delivery of the books (1).

20 Claims, 4 Drawing Sheets

BINDING-IN MACHINE

BACKGROUND

The invention pertains to a binding-in machine for pressing in and joint forming books.

After casing-in the book block in the case, a crease-free and permanent glued connection between the end sheets of the book block and the inner surfaces of the case is produced by pressing in the book. In industrial book production, this full surface pressing step is carried out on so-called binding-in machines in combination with the joint forming, in which the case joints are formed and glued.

U.S. Pat. No. 2,921,322 describes a binding-in machine with a multitude of pressing devices that are arranged in a straight row and spaced apart from one another by identical distances, wherein each pressing device features a pair of opposite pressing plates that are spaced apart from one another by a variable distance and serve for exerting a pressing force upon the sides of a book. Pairs of oppositely arranged and heated joint forming rails are respectively spaced apart from one another by a variable distance and assigned to the stationary pressing devices in order to form the case joints. The joint forming rails are situated on a transport carriage that can be moved back and forward and simultaneously serve as transport means for incrementally advancing the books from station to station, wherein these joint forming rails ultimately return into their starting position in order to receive and transport another book. The joint forming consequently is realized by briefly pressing in the joint forming rails repeatedly, wherein this requires higher temperatures in the joint forming rails that are particularly critical when heat-sensitive case materials are used.

DE 10 2004 061 995 A1 describes an additional development of the aforementioned binding-in machine, in which the joint forming devices are situated on transport means that are guided along a closed circulation path such that the books can be advanced from pressing station to pressing station in a cyclic fashion while being constantly taken hold of by one and the same pair of joint forming rails. The books are no longer released by the joint forming rails such that more time is available for the heat to act upon the case material. One disadvantage can be seen in that the books are only held in the case joint by the joint forming rails during their transport.

EP 384 129 B1 discloses a binding-in machine with a multitude of pressing devices that are continuously driven along a closed oval circulation path, as well as joint forming devices arranged on the pressing devices. The infeed of the cased book blocks takes place on a straight section of the transport system and the delivery of the formed and backed books takes place on the opposite straight section. The full surface pressing is carried out while the entire surface of the books is permanently accommodated in the pressing devices and the joint forming rails may be continuously held in the closed position. The disadvantage of this machine can be seen in the significant constructive expenditure for the transport system with the circulating pressing devices and for the mechanisms for feeding, aligning and delivering the books into and out of the continuously moving pressing devices.

DE 44 22 783 A1 describes a binding-in machine, in which a series of pressing devices are arranged on a rotor that is intermittently driven about a vertical axis of rotation, wherein the pressing plates are arranged quasi-tangentially on the rotor circumference. The joint forming devices are situated on the pressing devices and moved forward together therewith. From the infeed to the delivery, the books are permanently held in one and the same pressing device. In this case, the joint forming rails may remain closed in an uninterrupted fashion.

This machine design results in a complicated and heavy construction due to the fact that, among other things, the driving elements for generating the pressing force during full surface pressing are arranged on a rotating rotor and the forces of pressure acting upon the books for realizing the full surface pressing need to be absorbed in the rotor construction. The high forces of gravity resulting therefrom limit the cycle rate. This cycle rate is also limited due to the fact that the books can only be fed into the pressing devices once the rotor has come to a standstill, and that not only the infeed, but also the aligning and post-forming need to take place during the standstill phase. A capacity increase is achieved with the paired arrangement of the pressing devices on the rotor. However, this requires a substantial additional expenditure for the two parallel book flows in the infeed section and the delivery section of the machine.

Another disadvantage of known binding-in machines with circulating pressing devices is their significant space requirement.

SUMMARY

The present invention is based on the objective of developing a binding-in machine for pressing in and joint forming book blocks cased into cases wherein it should be possible to reliably and flawlessly realize the pressing and joint forming of the books, as well as a high cycle rate, with a compact construction.

This objective is attained in that the pressing devices with the joint forming devices can be driven such that they circulate along a closed path that essentially lies in a vertical plane, wherein the pressing plates are oriented parallel to this plane. The advantage of a reliable transport is achieved in that the books are continuously held in one and the same pressing device during their circulation. The joint forming rails may remain continuously closed in order to realize a gentle joint forming process. The vertical arrangement of the circulation path results in an exceptionally compact machine. Only a small floor area is required. Due to the pressing plates that are oriented parallel to the plane of circulation, the books accommodated in the pressing devices are situated in this plane of circulation during all phases of their transport. An infeed and a delivery of the books therefore also takes place, in principle, during the movement of the pressing device such that higher cycle rates of the binding-in machine can be achieved.

The joint forming rails of the joint forming devices are preferably always oriented transverse to the transport direction of the pressing devices. According to one advantageous additional development, the pressing devices are arranged on a rotor that rotates about a horizontal axis together with the joint forming devices, wherein the axis of rotation of the rotor is oriented perpendicular to the pressing plates.

The pressing devices with the pressing plates can be situated in an open position, a guiding position and/or a closed or clamping position. It is preferred that a format adjustment to the book thickness is realized during the positioning. In the closed or clamping position, at least a holding force that suffices for the reliable transport of the books in the circulating pressing devices can be exerted between the pressing plates.

According to another embodiment, the joint forming rails of the joint forming devices can be actuated for forming, holding and/or releasing the case joints. The joint forming rails are preferably spaced apart from the book spine by a large distance in the release position.

It is advantageous if the pressing devices and the assigned joint forming devices can be closed and opened above the book center because the desired book shape is also realized symmetrically referred to the book center.

The pressing devices with the joint forming devices are preferably driven intermittently such that, according to an advantageous additional development, stationary work stations for feeding, aligning, post-forming, pressing and/or delivering the books may be arranged along the circulation path.

It is particularly advantageous to realize a stationary feeding and aligning station with a horizontally arranged alignment table that supports the book in the spine region and a forming rail that can be lowered on the fore edge cut. In this case, the alignment process is not carried out on a moving book and can also be comfortably observed and corrected, if so required.

The advantage of a higher cycle rate is achieved by feeding the books in the plane of the circulation path essentially transverse to the transport direction of the pressing devices, wherein the infeed already takes place when the respective pressing device is still advanced to the feeding and aligning station.

It is advantageous if the actual pressing of the books takes place in at least one stationary pressing station, in which the pressing plate situated in the clamping position can be additionally acted upon with a high force of pressure generated by the pressing means supported in the machine frame. The pressing devices do not have to exert this high pressing force themselves, but rather only a much lower holding force. They can be designed much lighter and simpler such that the moving mass of the circulation system is maintained small and an additional increase in the cycle rate can be achieved.

A stationary delivery station is preferably provided for the gripped delivery of the formed and backed books, wherein the pressing device is controlled into the guiding position with minimally opened pressing plates in this case and the books are pulled out of the respective pressing device by means of joint clamping rails that engage into the formed case joints in order to be transferred to a downstream transport system. Even books adhering to the pressing plates are quickly and reliably removed from the pressing devices. The joint clamping rails are preferably situated on a pivoted arm that moves in said circulation path, wherein the pivoting arm approaches the respective pressing device in the same transport direction and moves away from the pressing device in the opposite direction when the books are pulled out.

In order to additionally increase the capacity, two arrangements of circulating pressing devices may be positioned parallel to one another. The advantage of a direct alternate transfer of books delivered from an upstream casing-in machine is achieved by driving the two arrangements offset in phase by 180°.

BRIEF DESCRIPTION OF THE DRAWINGS

The characteristics of one embodiment of the present invention are described in greater detail below with reference to the enclosed figures, in which.

DETAILED DESCRIPTION

Figure 1:
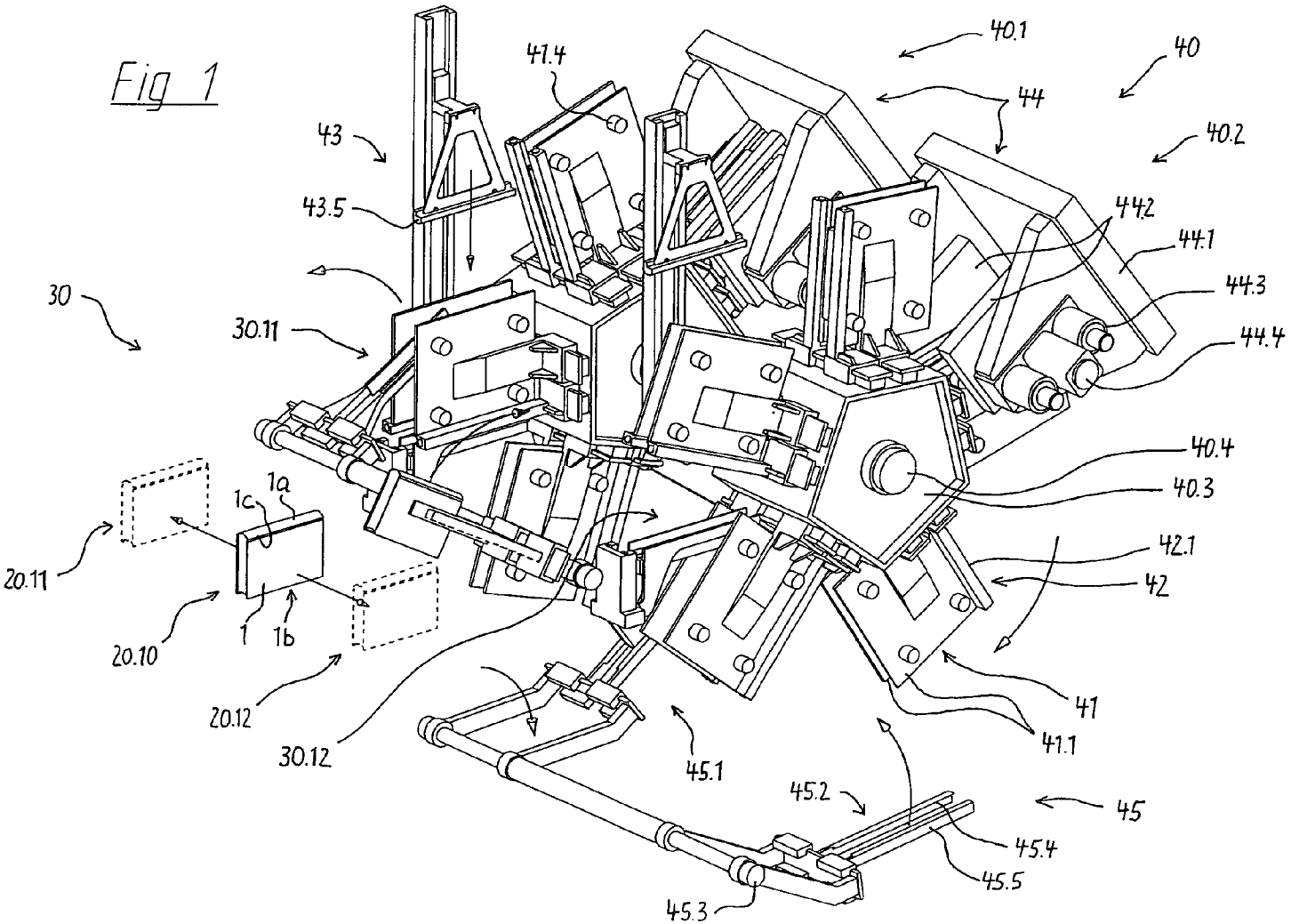
FIG. 1 is a schematic perspective representation of a binding-in machine with two rotors that are arranged parallel to one another in a first moving phase.

Book blocks 2 and cases 3 are connected into books 1 in a casing-in machine 10. A binding-in machine 40 is arranged downstream of the casing-in machine 10 and produces a crease-free and permanent glued connection between the end sheets of the book block 2 and the inner pages of the case by pressing in the book 1. This full-surface pressing step takes place in combination with the joint forming step, during which the case joints 1*c* are formed and glued.

The inventive binding-in machine 40 described further below is directly coupled to the casing-in machine 10 by means of a book delivery 20 that continuously holds the books 1, as well as an assigned gripper 30.1 or 30.2 that can be pivoted back and forward such that a separate cyclic feed of the books 1 is not required. However, the inventive machine may also be used as an individual machine with a corresponding cyclic feed device.

The function of the casing-in machine 10 with the book delivery 20 is initially described below with reference to FIG. 3. The book blocks 2 are fed to a circulation conveyor 10.3 by a book block transport chain 10.1, wherein said circulation conveyor transports the book blocks 2 astraddle on support plates 10.4 such that they are always positioned vertically. During the vertical transport movement of the book blocks, glue is applied over the entire surface of their end sheets by means of gluing rollers 10.6 and the book blocks are subsequently connected to cases 3 supplied by a case transport unit 10.2. The thusly created books 1 may subsequently also pass through pressing rollers 10.7.

During the additional transport, the downwardly moving books 1 reach a book delivery unit 20 that lies in the plane of motion 10.5 of the support plates 10.4, wherein the fore edge cut 1*b* of the books 1 is placed onto a stripping element 20.5 that features a through-slot for guiding through the support plates 10.4. The stripping element 20.5 forms part of the a book receptacle, by means of which the books 1 can be transferred from the stripping position 20.10 into a delivery position 20.11 or 20.12 that is offset parallel to the plane of motion, namely while the books are additionally supported by lateral supporting rails 20.6.

Figure 2:
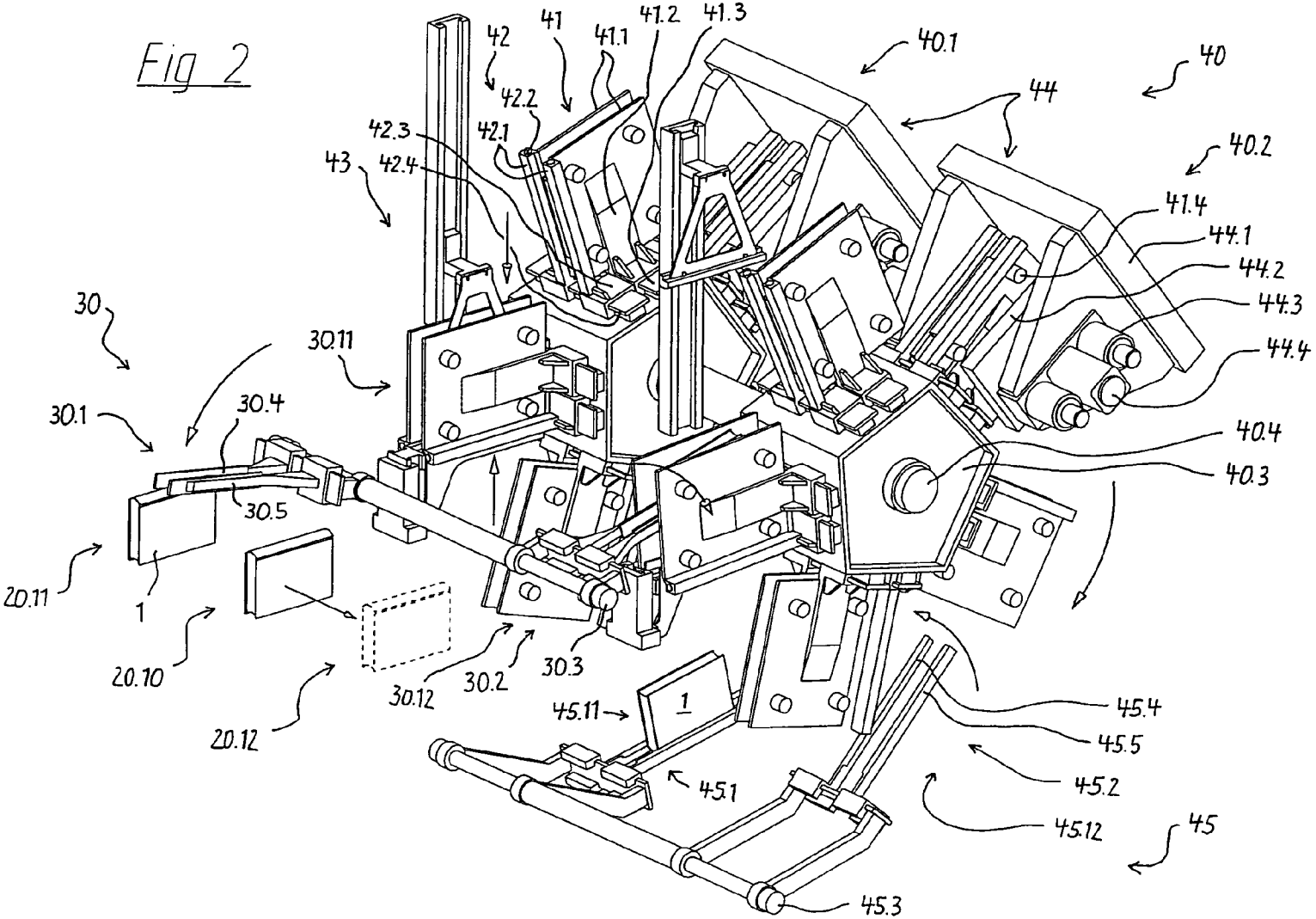
FIG. 2 is a representation according to FIG. 1 of the binding-in machine in a second moving phase.

In order to divide the book flow situated in the circulation conveyor 10.3, a first and a second book receptacle may alternately receive the books 1 from the stripping position 20.10 and transfer the books into left and right delivery positions 20.11 and 20.12 referred to the plane of motion (in this context, see FIGS. 1 and 2).

In order to process the divided book flow, the binding-in machine 40 illustrated in the figures consists of left and right binding-in machines 40.1 and 40.2 that are essentially realized identically, but intermittently driven offset in phase by 180°. A multitude of pressing devices 41 are respectively arranged in these binding-in machines on a rotor 40.3, the axis of rotation 40.4 of which is oriented perpendicular to the pressing devices 41 and extends horizontally such the pressing devices 41 quasi revolve overhead in a vertical plane. The joint forming devices 42 are also situated on the rotor 40.3 and rotate together with the pressing devices 41. Their joint forming rails 42.1 essentially extend radially referred to the axis of rotation 40.4 of the rotor.

The binding-in machine is designed such that the books 1 are continuously held in one and the same pressing device 41 and that the joint forming rails 42.1 heated by means of heating rods can be continuously held in the closed position so as to realize a gentle joint forming process.

The pressing devices 41 are formed by a pair of opposite pressing plates 41.1 that are spaced apart by a variable distance and can be set into an open position 41.11, a guiding position 41.12 and a clamping position 41.13 symmetrically above the book center while being accommodated on the actuating arms 41.2. The actuating arms 41.2 are guided in a guide rail 41.3 fixed on the rotor 40.3. The control means for the actuation of the actuating arms 41.3 and therefore the pressing plates 41.1 may consist of pneumatic, hydraulic or electric driving means or engage into mechanical cam plates. A specific design is not illustrated in the figures in order to provide a better overview.

The joint forming rails 42.1 of the joint forming devices 42 are accommodated on actuating arms 42.3 that are displaceably guided in guide rails 42.4 fixed on the rotor 40.3 and actuated symmetrically above the book center with the aid of not-shown control means in order to form, hold and/or release the case joints 1*c* by means of the joint forming rails 42.1. In the release position, the joint forming rails 42.1 are spaced apart from the book spine by a large distance such that the books 1 can be received and delivered in the plane of motion of the pressing devices 41.

The intermittent rotor movement makes it possible to act upon the books 1 by means of stationary work stations in the standstill positions of the pressing devices 41, for example, in order to feed, align, post-form, press in or deliver the books.

The feeding and aligning station 43 is initially described below. It is situated at a location at which the pressing devices 41 with the joint forming devices 42 are oriented horizontally in order to accommodate the books 1 with the spine 1*a* pointing downward. As mentioned above, the books 1 are delivered out of the casing-in machine 10 in a left and a right delivery position 20.11 and 20.12 with the spine 1*a* pointing upward.

A double book gripper 30 arranged upstream of the feeding and aligning station 43 makes it possible to transfer the books 1 from the respective left and right delivery positions 20.11 and 20.12 (in the form of upstream transfer positions) into (from the viewpoint of the casing-in machine 10) second left and right delivery positions 30.11 and 30.12, wherein the books 1 are turned and directly deposited on an alignment table 43.1 of a feeding and aligning station 43 with their spine 1*a*.

The double book gripper 30 features a left and a right book gripper 30.1 and 30.2 for transferring the divided book flow, wherein said book grippers can be pivoted back and forward about a pivoting axis 30.3 by 180°, namely in a diametrically opposite fashion as symbolized in the figures with corresponding motion arrows. The books 1 are laterally taken hold of by a left and a right clamping jaw 30.4 and 30.5 in a region that is left exposed by the left and right supporting rails 20.6. For this purpose, the supporting rails 20.6 are realized in an L-shaped fashion.

Figure 3:
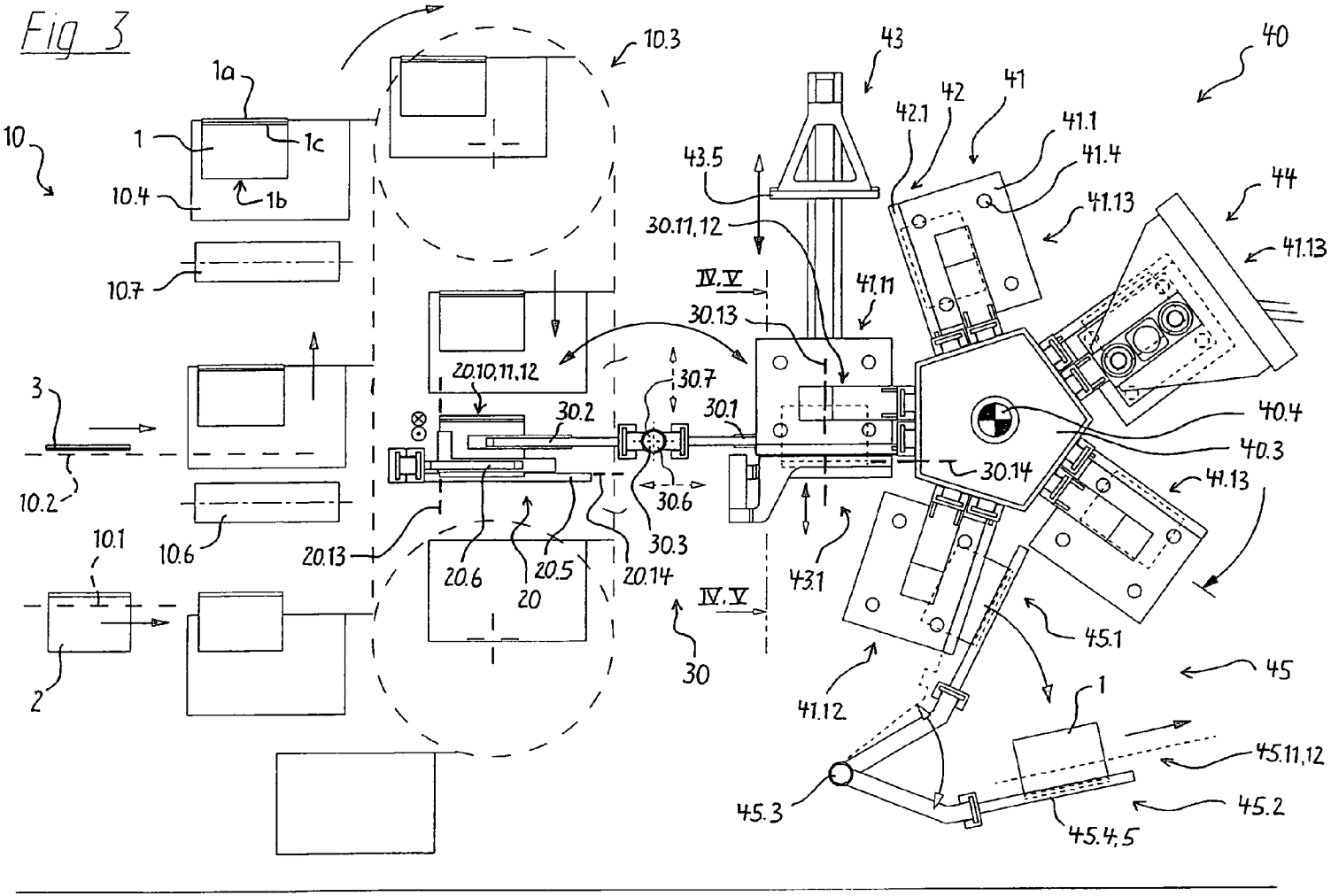
FIG. 3 is a schematic side view of the binding-in machine with an upstream casing-in machine.

It is possible to deposit the books 1 on the alignment table 43.1 in a predetermined position with parallel pivot point adjustments 30.6, 30.7 of the pivoting axis 30.3 in the horizontal direction and the vertical direction—as symbolically illustrated with broken double arrows in FIG. 3.

The horizontal pivot point adjustment 30.6 makes it possible to define the position of the books in the horizontal direction, i.e., in the direction in which the book height extends. In the casing-in machine 10, the books 1 are transported astraddle on the support plates 10.4 with a foot edge 20.13 of fixed format. However, in the binding-in machine 40, a book center 30.13 of fixed format is desirable such that the books 1 are centrally clamped in the pressing devices 41. During format changes, this reference edge change can be automated in the form of a corresponding horizontal pivot point adjustment 30.6 in dependence on the respective change in the book height.

The vertical pivot point adjustment 30.7 makes it possible to define the position of the books in the vertical direction, i.e., in the direction in which the book width extends. After being positioned on the stripping element 20.5, the books 1 are delivered out of the casing-in machine 10 with the fore edge cut 1*b* as fixed reference edge 20.14. However, the books 1 need to be fed to the binding-in machine 40 with the spine 1*a* as fixed reference edge 30.14. During format changes, this reference edge change can be automated in the form of a corresponding vertical pivot point adjustment 30.7 in dependence on the respective change in the book width, wherein the spine shape, i.e., a straight or a curved spine shape, as well as the radius of the curvature, can also be taken into account.

As described above, the books 1 are deposited on the alignment table 43.1 with their spine 1*a* in the feeding and aligning station 43. The alignment table is formed by two prism strips 43.2 that are arranged parallel to one another and support the respective book 1 on the outer edges of its book spine with plane, inclined supporting surfaces for the outer edges of the book spine, wherein the distance between the prism strips 43.2 is adjustable with respect to the book thickness.

The respective book gripper 30.1 or 30.2 directly transfers the books 1 between the pressing plates 41.1 of the pressing devices 41 that are initially controlled into a correspondingly opened position 41.11 for this purpose and closed into a guiding position 41.12 after the book gripper 30.1 or 30.2 is pivoted away in order to form a defined guide channel, in which the books 1 to be aligned are tightly guided.

Figure 4:
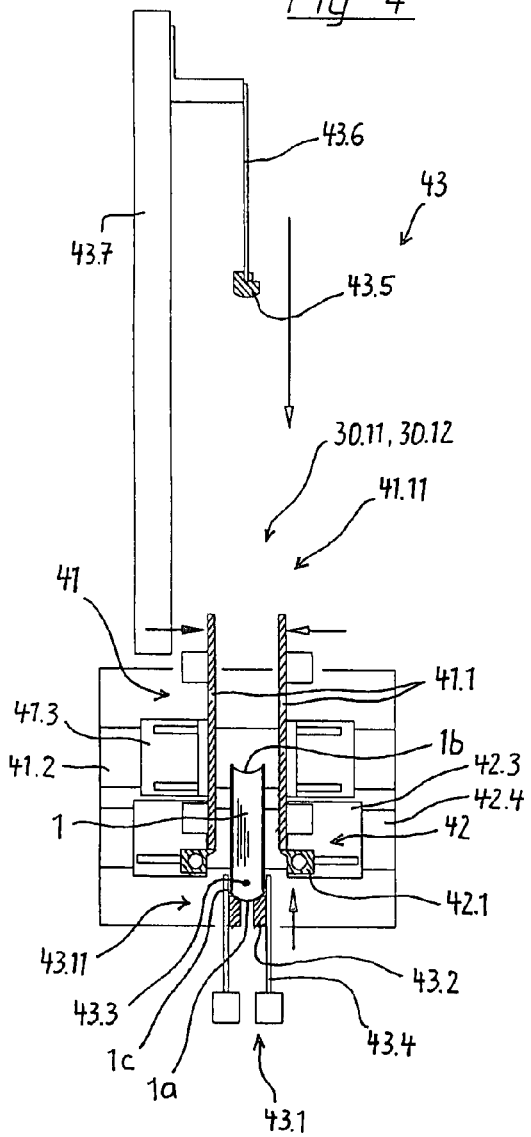
FIG. 4 is a section through the feeding and aligning station of the binding-in machine with a book deposited therein, namely along the line of section IV in FIG. 3.
Figure 5:
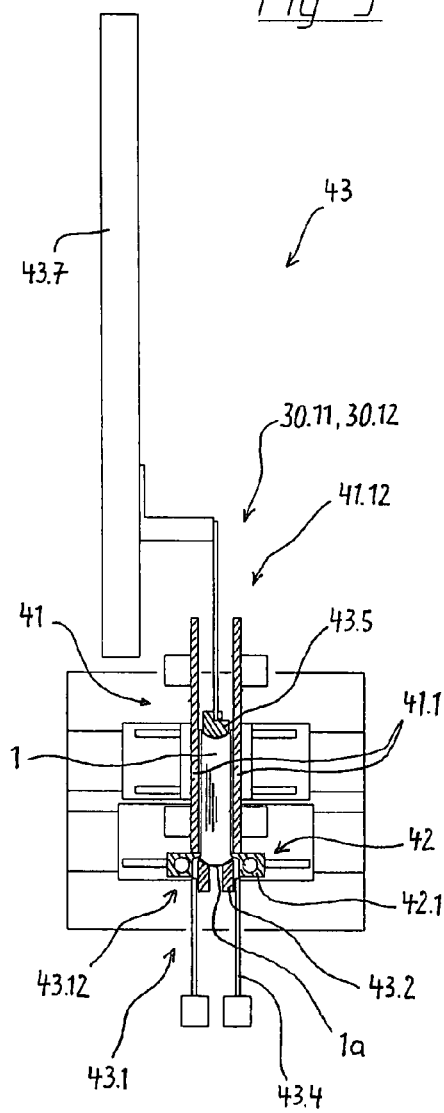
FIG. 5 is a section according to FIG. 4 through the feeding and aligning station in the instant in which a book is aligned and post-formed.

Stationary lateral guides 43.4 that can be adjusted to the book thickness are assigned to the alignment table 43.1 in order to form a shaft 43.3 that holds the books 1 in the vertical position, wherein the alignment table 43.1 is controlled into a lowered depositing position 43.11 referred to the height of the joint forming rails 42.1 while it receives a book 1 from the book gripper 30.1 or 30.2, respectively, and raised into a predefined aligning position relative to the lateral guides 43.4 in order to align and post-form the book 1, and wherein the books 1 are in the meantime supported by the pressing plates 41.1 (see FIGS. 4 and 5).

The alignment table 43.1 is only raised by a short stroke such that no unnecessary capacity restrictions are created. Alternatively, the alignment table 43.1 may be fixed in said alignment position 43.12, in which case the lateral guides 43.4 are downwardly moved out of the effective range of the pressing plates 41.1.

When the alignment table 43.1 is raised, a forming rail 43.5 that can be moved up and down in a guide rail 43.7 on a support arm 43.6 is initially lowered on the fore edge cut 1*b* of the book 1 with a slight force of pressure in order to subsequently press the book block into the spine of the case with an increased force of pressure after the joint forming rails 42.1 take hold of the case joints 1*c* and thusly post-form the book, wherein the alignment table 43.1 is, if applicable, minimally lowered. Both cover boards are pulled against the joint forming rails 42.1 by means of the jointed center strip and end sheet. The book block 2 and the case 3 can thusly be aligned relative to one another while simultaneously post-forming the book 1.

The plane of motion of the respective book gripper 30.1 or 30.2 is identical to the plane of motion of the pressing devices 41. This makes it possible to feed the books 1 while the rotor 40.3 is still driven, wherein the respective pressing device 41 is quasi moved upward into the aligning and post-forming station 43 around the alignment table 43.1 while its pressing plates 41.1 are controlled into the open position 41.11. The rotational movement of the pressing devices 41 ideally comes to a standstill when the book gripper 30.1 or 30.2 has deposited a book 1 to be processed on the alignment table 43.1 and is already pivoted back out of the effective range of the pressing plates 41.1 such that the pressing devices 41 can be controlled into their guiding position 41.12 immediately thereafter and the alignment table 43.1 carrying the book 1 can be raised into the aligning position 43.12.

After the aligning and post-forming processes are completed, the forming rail 43.5 is upwardly moved out of the pressing plates 41.1 and the pressing device 41 is controlled into its clamping position 41.13, in which the full surface of the books 1 is already subjected to a certain pressure. In addition, the heated joint forming rails 42.1 close with increased pressure in order to form the case joints 1*c*. The rotor movement may begin in the instant in which the forming rail 43.5 is lifted off the fore edge cut 1*b* of the book 1 in order to respectively advance the pressing devices 41 by one position.

During their intermittent rotation, the pressing devices 41 pass through a not-shown pressing station, in which an increased force of pressure can be externally exerted upon the pressing plates 41 while the rotor is at a standstill in order to realize the actual full-surface pressing of the books 1. Pressure plates 44.2 are accommodated in a machine frame 44.1 with the aid of linear guides 44.3, wherein said pressure plates may, for example, be opened and closed by hydraulic pressure cylinders 44.4 and act upon pressure cushions 41.4 of the pressing plates 41.1.

Furthermore, a delivery station 45 is provided, in which the books 1 can be removed from the pressing devices 41. In order to alternately remove the books 1 from the two separate binding-in machines 40.1 and 40.2, the delivery station, features a left and a right gripper 45.1 and 45.2 that can be pivoted back and forward in opposition of phase about a pivoting axis 45.3 that is symbolized in the figures with corresponding motion narrows. The books are taken hold of in the case joint 1*c* by means of left and right joint clamping rails 45.4 and 45.5 and pulled out of the pressing devices 41 that are controlled into the guiding Position 41.12 in order to be transferred into a left and a right delivery position 45.11 and 45.12. In order to take hold of the case joints 1c, the joint forming rails 42.1 are retracted into a release position. The books 1 are subsequently received by a not-shown transport system and transported away from the binding-in machine.

The invention claimed is:

1. A binding-in machine for pressing in and joint forming books having a case, a book block with a fore edge cut and a spine, the machine including devices for aligning the book block relative to the case, comprising:

a multitude of pressing devices that respectively feature a pair of opposite pressing plates, the distance between which can be varied in order to exert full-surface pressure upon the sides of the book, and a case joint forming device provided with each of said pressing devices including a pair of opposite heated joint forming rails, the distance between which can be varied in order to form case joints on the books, said pressing devices with the case joint forming devices being driven such that they circulate along a closed path that essentially lies in a vertical plane, said pressing plates being oriented parallel to this plane and said joint forming rails lying in planes parallel to this plane.

2. The binding-in machine according to claim 1, wherein the circulation of the pressing devices and the joint forming devices along the closed path defines a transport direction and the joint forming rails of the case joint forming devices are always oriented transverse to the transport direction of the pressing devices.

3. The binding-in machine according to claim 1, wherein the pressing devices with the case joint forming devices are arranged on a rotor that is rotatable about a horizontal axis, said axis of the rotor being oriented perpendicular to the pressing plates.

4. The binding-in machine according to claim 1, wherein the pressing devices with the pressing plates each has distinct positions including an open position for receiving a book, a guiding position for lightly clamping a book, and a closed position for tightly clamping a book.

5. The binding-in machine according to claim 4, wherein a format adjustment to the book thickness is carried out during the positioning.

6. The binding-in machine according to claim 4, wherein at least a holding force is exerted between the pressing plates in the closed position.

7. The binding-in machine according to claim 1, wherein the joint forming rails of the case joint forming devices have three positions that form, hold release the case joints, respectively.

8. The binding-in machine according to claim 7, wherein the joint forming rails are spaced apart from the book spine by a large enough distance in the release position to receive a book.

9. The binding-in machine according to claim 4, wherein (a) the pressing devices and the case joint forming devices are carried on a rotor, (b) the rotor carries can actuator for each pressing device and an actuator for each case joint forming device, (c) when a book is between the pressing plates the actuator for the pressing plates and the actuators for the case joint forming rails are located closer to the fore edge cut than to the spine.

10. The binding-in machine according to claim 7, wherein (a) the pressing devices and the case joint forming devices are carried on a rotor, (b) the rotor carries an actuator for each pressing device and an actuator for each case joint forming device, (c) when a book is between the pressing plates the actuator for the pressing plates and the actuators for the case joint forming rails are located closer to the fore edge cut than to the spine.

11. The binding-in machine according to claim 1, wherein the pressing devices with the case joint forming devices are carried on a rotor which rotates intermittently.

12. The binding-in machine according to claim 7, wherein the pressing devices with the case joint forming devices are carried on a rotor which rotates intermittently.

13. The binding-in machine according to claim 11, including processing stations arranged along the circulation path for at least one of infeeding, aligning, post-forming, additionally pressing in and delivering the books.

14. The binding-in machine according to claim 13, wherein a feeding and aligning station has a horizontally arranged aligning table that supports the book in the spine region and includes a vertically oriented forming rail above the fore edge cut of the book as supported on the aligning table.

15. The binding-in machine according to claim 14, wherein the infeed takes place in the plane of the circulation path essentially transverse to the transport direction of the pressing devices.

16. The binding-in machine according claim 13, wherein the binding-in machine has a machine frame and at least one stationary additional pressing station is supported by the machine frame at a location along the circulation path where the pressing plates of the respective pressing devices are situated in the clamping position and pressing devices on the stationary pressing station subject the pressing plates to a higher force of pressure in order to press in a book situated between the pressing plates.

17. The binding-in machine according claim 13 wherein said delivery station provides for the gripped delivery of the formed and backed books, wherein each circulating pressing device is controlled into a guiding position with minimally opened pressing plates and the books are pulled out of the respective pressing device by joint clamping rails at the delivery station that engage into the formed case joints.

18. The binding-in machine according to claim 17, wherein the joint clamping rails are situated on a pivoted arm that is moved along said circulation path and approaches the respective pressing device in the same transport direction and the pivoted arm is moved away from the pressing device in the opposite direction when the books are pulled out.

19. The binding-in machine according to claim 1 wherein two arrangements of circulating pressing devices are provided and arranged parallel to one another referred to their circulation path.

20. The binding-in machine according to claim 19, wherein the two arrangements are driven offset in phase by 180°.

* * * * *